US006538369B1

(12) United States Patent
Lee et al.

(10) Patent No.: US 6,538,369 B1
(45) Date of Patent: Mar. 25, 2003

(54) CATHODE RAY TUBE HAVING PARTICULAR FUNNEL STRUCTURE

(75) Inventors: Bong-Woo Lee, Kyungki-do (KR); Do-Nyun Kim, Kyungki-do (KR)

(73) Assignee: Samsung SDI Co., Ltd., Suwon-si (KR)

( * ) Notice: Subject to any disclaimer, the term of this patent is extended or adjusted under 35 U.S.C. 154(b) by 151 days.

(21) Appl. No.: 09/585,247

(22) Filed: May 31, 2000

(30) Foreign Application Priority Data

Jun. 1, 1999 (KR) ..... 99-20046

(51) Int. Cl.[7] ..... H01J 29/70
(52) U.S. Cl. ..... 313/440; 313/477 R; 313/634
(58) Field of Search ..... 313/440, 477 R, 313/467, 634

(56) References Cited

U.S. PATENT DOCUMENTS 6,188,173 B1 * 2/2001 Kang et al. ..... 313/477 R
6,268,692 B1 * 7/2001 Yokota et al. ..... 313/477 R
6,307,313 B1 * 10/2001 Fukuda ..... 313/421
6,307,314 B1 * 10/2001 Sano ..... 313/440
6,323,591 B1 * 11/2001 Oosterhout et al. ..... 313/477 R
6,359,379 B1 * 3/2002 Lee et al. ..... 313/477 R
6,380,668 B1 * 4/2002 Kim et al. ..... 313/477 R
6,380,699 B2 * 4/2002 Miyazaki et al. ..... 315/368.28
6,384,525 B1 * 5/2002 Sano et al. ..... 313/440
6,404,117 B1 * 6/2002 Soneda et al. ..... 313/440

* cited by examiner

*Primary Examiner*—Vip Patel
*Assistant Examiner*—Kevin Quarterman
(74) *Attorney, Agent, or Firm*—Christie, Parker & Hale, LLP

(57) ABSTRACT

A cathode ray tube with a central axis includes a panel with an inner phosphor screen, and a funnel connected to the panel. The funnel has a cone portion with a neck sealing side, and a body portion extended from he cone portion to the panel. A deflection yoke is externally mounted around the funnel. A neck is connected to the neck sealing side of the cone portion. An electron gun is mounted within the neck. The funnel is structured to satisfy the following condition:

$$0.52+0.001\times(\alpha/2+\phi)<b/a<0.74+0.001\times(\alpha/2+\phi)$$

where a indicates the distance (mm) between the reference line R/L and the too of round TOR on the tube axis line, b indicates the disance (mm) between the reference line and the neck sealing side of the cone portion on the tube axis Z line, $\alpha$ indicates the deflection angle (degree), and $\phi$ indicates the diameter (mm) of the neck.

2 Claims, 2 Drawing Sheets

CATHODE RAY TUBE HAVING PARTICULAR FUNNEL STRUCTURE

FIELD OF THE INVENTION

The present invention relates to a cathode ray tube (CRT) and, more particularly, to a CRT that can reduce power consumption for deflecting electron beams by improving the structural characteristics of a funnel.

BACKGROUND OF THE INVENTION

Generally, CRTs include a panel having an inner phosphor screen, a funnel having a cone portion, and a neck having an electron gun therein, which are sequentially connected to each other. A deflection yoke is mounted around the cone portion of the funnel to form horizontal and vertical magnetic fields there. In this structure, electron beams emitted from the electron gun are deflected through the horizontal and vertical magnetic fields from the deflection yoke, and land the phosphor screen.

Recently, CRTs have been employed for use in highly sophisticated electronic devices such as high definition television (HDTV) and OA equipment.

On the one hand, in these applications, the consumption of power of the CRT should be reduced to obtain good energy efficiency, and the leakage rom the magnetic field due to the power consumption should be reduced to protect the user from the harmful electronic waves. In order to cope with these requirements, it turns out that the consumption of power of the deflection yoke, which Is the major consumption source, should be reduced in a suitable manner.

On the other hand, in order to realize high brightness and resolution of display images on the screen, it Is required that the deflection power of the deflection yoke increase. Specifically speaking, higher anode voltage is required for enhancing brightness of the screen and, correspondingly, higher deflection voltage is required for deflecting the electron beams accelerated by she increased anode voltage. Furthermore, higher deflection frequency is required for enhancing resolution of the screen, and this accompanies the requirement of increased deflection power.

In addition, in order to realize relatively flat CRTs for more convenient use, wide-angle deflection should be performed with respect to the electron beams, and this also accompanies the requirement of increased deflection power.

In this situation, there are needs for developing techniques for allowing the CRTs to retain good deflection efficiency while constantly maintaining the deflection power or reducing it.

For this purpose, conventionally, a technique for increasing the deflection efficiency is introduced by positioning the deflection yoke to be closer to the electron beam paths. The positioning of the deflection yoke is usually achieved by reducing the diameter of the neck. However, in such a technique, as the diameter of the neck is reduced, the size of the electron gun to be mounted within the neck as well as the curvature of the funnel to be connected to the neck should be correspondingly varied, and this results in complicated processing steps. Furthermore, in such a structure, it turns out that the focusing characterist c of the electron gun poor.

Alernatively, in order to reduce the deflection power consumption, it is suggested that the diameter of the neck is constantly kept to be about 29.1ϕ and, instead, the neck-sided outer diameter of the funnel becomes smaller.

However, in such a structure, the electron beams to be applied onto the screen corner portions are liable to bombard the inner wall of the funnel adjacent to the neck (This phenomenon is usually called the "beam shadow reck" or briefly the "BSN"). Consequently, the phosphors coated on the corresponding screen corner portions are not excited so that it becomes difficult to obtain good quality screen images.

In short, the techniques of decreasing the deflection power consumption simply by reducing the diameter of the neck or the neck-side outer diameter of the funnel necessarily involve the beam shadow, neck or other device failures because they cannot correctly deflect the practical moving routes of the electron beams.

SUMMARY OF THE INVENTION

It is an object of the present Invention to provide a CRT that is designed to reduce power consumption for deflecting electron beams without involving any beam shadow neck.

This and other objects may be achieved by a CRT with a central axis. The CRT includes a panel with an inner phosphor screen, and a funnel connected to the panel. The funnel has a cone portion with a neck sealing side, and a body portion extended from the cone portion to the panel. A deflection yoke is externally mounted around the funnel. A neck is connected to the neck sealing side of the cone portion. An electron gun is mounted within the neck.

The meeting point between the cone portion and the body portion indicated by a top of round (TOR). Furthermore, if two lines are drawn from the centers of the diagonal edges of the phosphor screen opposite to each other to a point of the tube axis line such that the angle between the tube axis line and each of the two lines reaches half the maximum deflection angle, a reference line (R/L) is indicated by the line crossing the point of the tube axis line normal thereto.

In this connection, the funnel is structured to satisfy the following condition:

$$0.52+0.001\times(\alpha/2+\phi)<b/a<0.74+0.001\times(\alpha/2+\phi)$$

where a indicates the distance (mm) between he reference line R/L and the top of round TOR on the tube axis line, b indicates the distance (mm) between the reference line and the neck sealing side of the cone portion on the tube axis Z line, a indicates the deflection angle (degree), and ϕ indicates the diameter (mm) of the neck.

DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION

Preferred embodiments of this invention will be explained with reference to the accompanying drawings.

Figure 1:
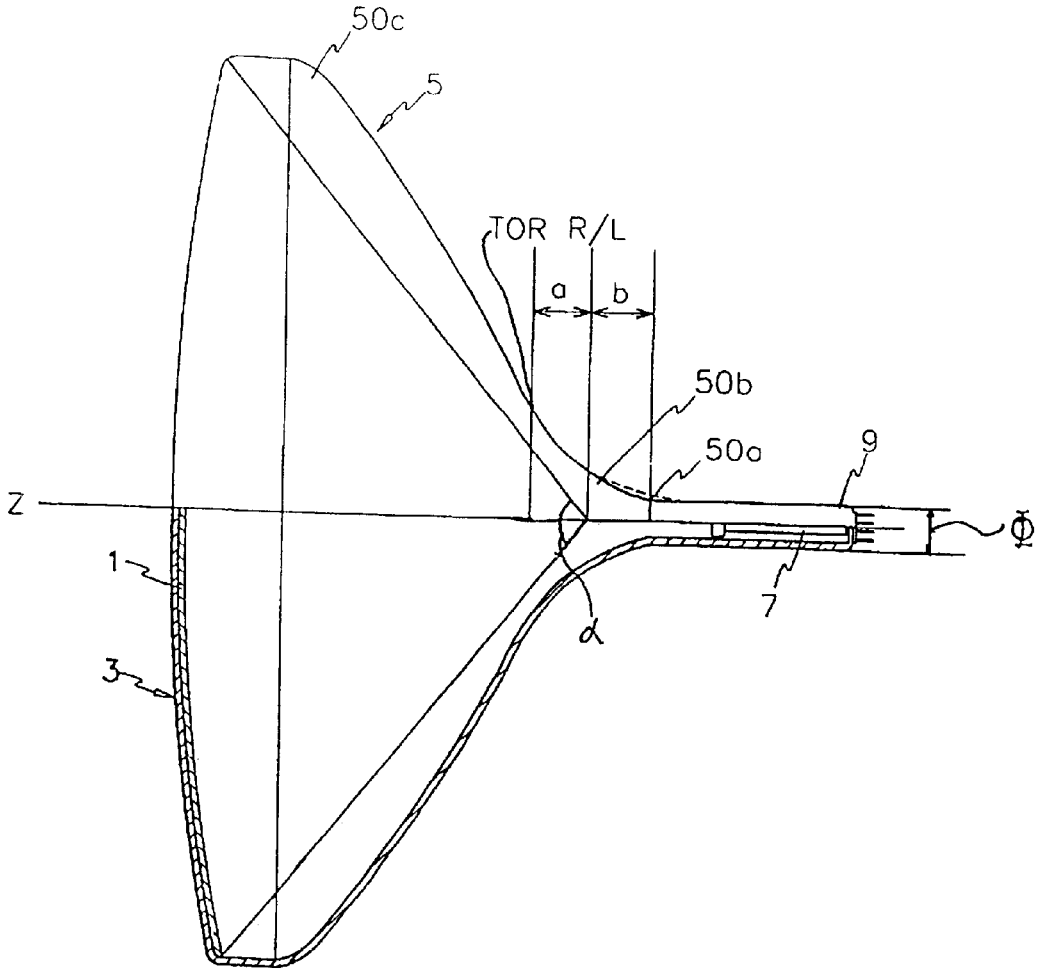
FIG. 1 is a side half sectional view of a CRT according to a preferred embodiment of the present invention.

FIG. 1 is a side half sectional view of a CRT with a central axis Z according to a preferred embodiment of the present invention. As shown in FIG. 1, the CRT includes a faceplate panel 3 with an inner phosphor screen 1 and a rear portion.

The phosphor screen 1 is substantially rectangular-shaped with four diagonal edges. A funnel 5 is connected to the rear portion of the panel 3, and a deflection yoke not shown) is externally mounted around the funnel 5. The funnel 5 is in turn connected to a neck 9 that is internally mounted with an electron gun 7.

Specifically, the funnel 5 has a cone portion 50*b* with a neck sealing side 50*a* to which the neck 9 is sealed, and a body portion 50*c* extended from the cone portion 50*b* to the panel 3 while being swiftly enlarged toward the panel 3.

The meeting point between the cone portion 50*b* and the body portion 50*c* becomes an inflection point where she inner curved surface of the funnel 5 changes from depression (corresponding to he body portion 50*c*) to prominence (corresponding to the cone portion 50*b*). Such an inflection point is usually called the "top of round (TOR)".

Furthermore, the so-called reference line R/L is defined as follows: where two lines are drawn from centers of the diagonal edges of the phosphor screen 1 opposite to each other to a point of the tube axis Z line such that the angle between the tube axis Z line and each of the two lines reaches half the maximum deflection angle, the reference line R/L is indicated by the line crossing the point of the tube axis Z line normal thereto.

In this connection, the funnel 5 is structured to satisfy the following condition:

$$0.52+0.001\times(\alpha/2+\phi)<b/a<0.74+0.001\times(\alpha/2+\phi)$$

where a indicates the distance (mm) between the reference line R/L and the top of round TOR on the tube axis Z line, b indicates the distance (mm) between the reference line R/L and the neck sealing side 50*a* of the cone portion 50*b* on the tube axis Z line, $\alpha$ indicates the deflection angle (degree), and $\phi$ indicates the diameter (mm) of the neck 9.

Figure 2:
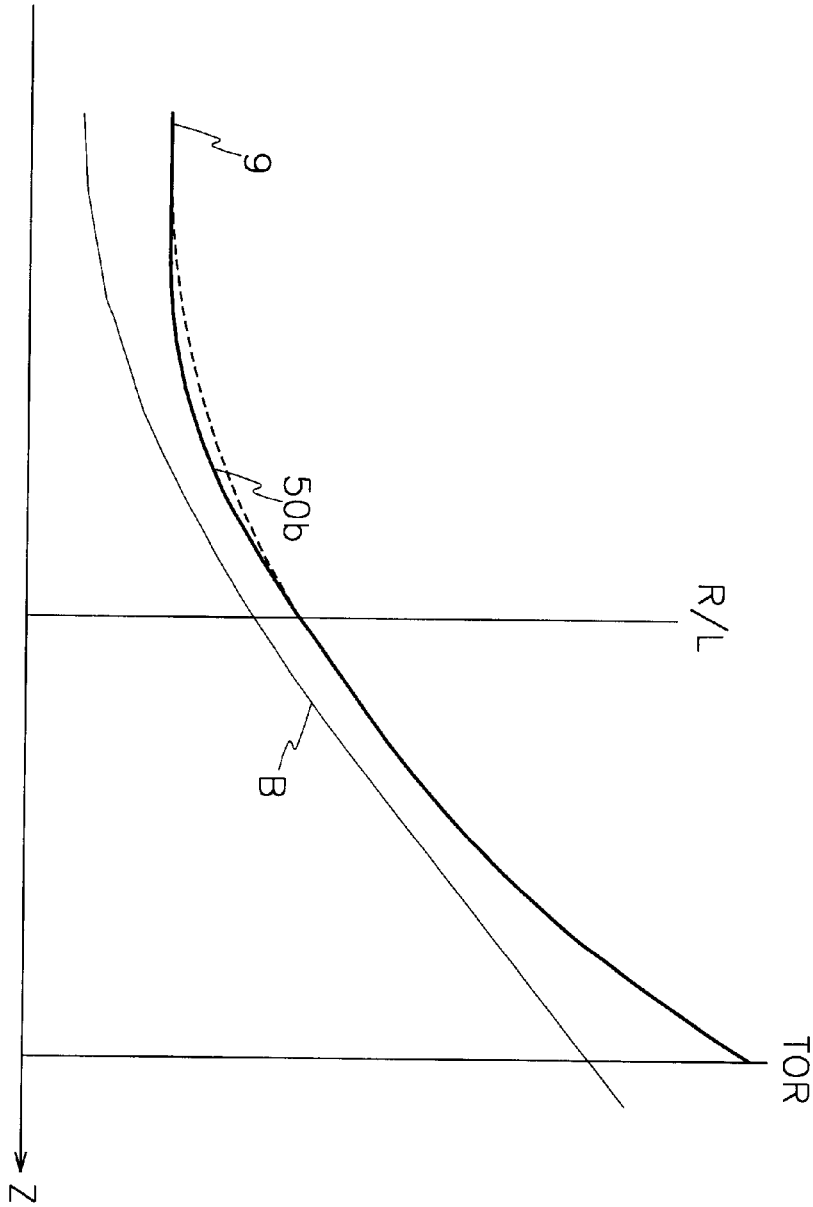
FIG. 2 illustrates an outline of the CRT shown in FIG. 1 analyzed by a computer simulation technique.

FIG. 2 Illustrates an outline of the cone portion 50*b* analyzed by a computer simulation technique. In the drawing, the cone portion 50*b* of the funnel 5 is indicated by the dotted line, whereas a cone portion of the same-type funnel based on a prior art device is indicated by the solid line. It can be easily noted from the drawing that the cone portion 50*b* is reduced in size compared to the cone portion based on the prior art.

In order to test the beam shadow neck (BSN) characteristic of the CRT, computer simulation was performed with respect to the practical routes of electron beams B. It turned out that the cone portion 50*b* having a reduced size does not cause any BSN-related problem.

In the above structure, it naturally follows that the deflection yoke mounted around the core portion 50*b* becomes closer to the moving routes of the electron beams B, resulting in reduced power consumption for deflection. In this preferred embodiment, the amount of reduction is up to 9.76% compared to that of the conventional CRT.

A 17-inch CRT according to the preferred embodiment of the present invention was made, and compared with a 17-inch prior art CRT with respect to their structural characteristics. The results are listed in Table 1.

TABLE 1

| | $\alpha$ (degree) | $\phi$ (mm) | a (mm) | b (mm) | b/a |
|---|---|---|---|---|---|
| Present | 90 | 29.1 | 44.98 | 43.4 | 0.965 |
| Prior | 90 | 29.1 | 44.98 | 29.38 | 0.653 |

As described above, the inventive CRT can effectively reduce deflection power consumption without involving any beam shadow neck.

While the present invention has seen described in detail with reference to the preferred embodiments, those skilled in the art will appreciate the various modifications and substitutions can be made thereto without departing from the spirit and scope of the present invention as set forth in the appended claims.

What is claimed is:

1. A cathode ray tube with a central axis and a maximum deflection angle, the cathode ray tube comprising:

a panel with an inner phosphor screen, the phosphor screen being substantially rectangular-shaped with four edges;

a funnel connected to the panel, the funnel having a cone portion with a neck sealing side and a body portion extending from the cone portion to the panel;

a deflection yoke externally mounted around the funnel;

a neck connected to the neck sealing side of the cone portion of the funnel; and an electron gun mounted within the neck;

wherein a meeting point between the cone portion and the body portion is an inflection point, and wherein when two lines are drawn from centers of opposite edges of the phosphor screen to an intersection point on the central axis line such that an angle between the central axis line and each of the two lines is approximately half of the tube's maximum deflection angle, a reference line is indicated by a line that is normal to the central axis line at the intersection point, and further wherein the funnel satisfies the following condition:

$$0.52+0.001\times(\alpha/2+\Phi)<b/a<0.74+0.001\times(\alpha/2+\Phi)$$

where a indicates the distance on the central axis line between the reference line and a line normal to the central axis line that passes through the inflection point, b indicates the distance between the reference line and the neck sealing side of the cone portion on the central axis line, $\alpha$ indicates a deflection angle, and $\Phi$ indicates a diameter of the neck.

2. A cathode ray tube having a central axis and a maximum deflection angle, the cathode ray tube comprising:

a panel having an inner phosphor screen, the phosphor screen being substantially rectangular-shaped with four edges defining the rectangle;

a funnel connected to the panel, the funnel having a cone portion with a neck sealing side and a body portion extending from the cone portion to the panel, the cone and body portions connecting at a meeting point; and a neck connected to the neck sealing side of the cone portion of the funnel;

wherein the meeting point is an inflection point, and wherein when two lines are drawn from centers of opposite edges of the phosphor screen to an intersection point on the central axis line such that an angle between the central axis line and each of the two lines is approximately half of the tube's maximum deflection angle, a reference line is indicated by a line that is normal to the central axis line at the intersection point of the central axis line;

wherein the funnel satisfies the following condition:

$$0.52+0.001\times(\alpha/2+\Phi)<b/a<0.74+0.001\times(\alpha/2+\Phi)$$

where a indicates the distance on the central axis line between the reference line and a line normal to the central axis line that passes through the inflection point, b indicates the distance between the reference line and the neck sealing side of the cone portion on the central axis line, $\alpha$ indicates a deflection angle, and $\Phi$ indicates a diameter of the neck.

* * * * *